US006058667A

United States Patent [19]

MacDonald et al.

[11] Patent Number: 6,058,667

[45] Date of Patent: May 9, 2000

[54] MODULAR WINDOW FOR PARTITION PANELS

[75] Inventors: Douglas B. MacDonald, Caledonia; Theodore Q. Chau, Grand Rapids; Kevin J. Longhurst, Hastings; Richard S. Hand, Holland, all of Mich.

[73] Assignee: Steelcase Development Inc., Grand Rapids, Mich.

[21] Appl. No.: 09/060,911

[22] Filed: Apr. 15, 1998

[51] Int. Cl.[7] ..... E04B 2/74

[52] U.S. Cl. ..... 52/239; 52/205; 52/204.53; 52/204.54; 52/204.55; 52/656.5

[58] Field of Search ..... 52/205, 204.53, 52/204.54, 204.55, 239, 656.5

[56] References Cited

U.S. PATENT DOCUMENTS

| | | |
|---|---|---|
| 3,006,041 | 10/1961 | Thuet et al. . |
| 3,125,191 | 3/1964 | Singer et al. . |
| 3,323,262 | 6/1967 | Di Cesare, Jr. et al. . |
| 3,423,897 | 1/1969 | Birum, Jr. . |
| 3,478,478 | 11/1969 | Luebs . |
| 3,490,178 | 1/1970 | Voisin . |
| 3,750,358 | 8/1973 | Lewkowitz . |
| 3,881,287 | 5/1975 | Biebuyck . |
| 3,961,452 | 6/1976 | Hubbard et al. . |
| 4,897,975 | 2/1990 | Artwick et al. . |
| 5,038,539 | 8/1991 | Kelley et al. . |
| 5,088,250 | 2/1992 | DeLong et al. . |
| 5,155,955 | 10/1992 | Ball et al. . |
| 5,218,799 | 6/1993 | Appino . |
| 5,560,155 | 10/1996 | Back . |
| 5,713,167 | 2/1998 | Durham et al. . |

*Primary Examiner*—Christopher T. Kent
*Attorney, Agent, or Firm*—Price, Heneveld, Cooper, DeWitt & Litton

[57] ABSTRACT

A knock-down transparent module includes a module frame with a pair of vertical side frame members, each having an upper end and a lower end. Upper and lower horizontal frame members have opposite ends and extend generally horizontally between the vertical side frame members adjacent the upper and lower ends thereof and interconnect the same adjacent the upper and lower ends to define a central opening through the module frame. A transparent sheet is secured to the module frame and extends across the central opening. The module frame defines outer faces having at least one hook shaped to engage an opening in a partition frame member, thereby permitting the module frame to be removably supported within a partition.

33 Claims, 7 Drawing Sheets

MODULAR WINDOW FOR PARTITION PANELS

CROSS-REFERENCES TO RELATED APPLICATIONS

The present application is related to commonly assigned U.S. Pat. No. 5,899,035, issued on May 4, 1999, entitled KNOCK-DOWN PORTABLE PARTITION SYSTEM. The present applicationis also related to commonly assigned U.S. Pat. No. 6,009,675, issued on Jan. 4, 2000, entitled KNOCK-DOWN PORTABLE PARTITION SYSTEM, and U.S. Patent Application No. 09/060,913, filed on Apr. 15, 1998, entitled KNOCK-DOWN PORTABLE PARTITION SYSTEM. The entire contents of each of the above-identified applications and issues patents are hereby incorporated by reference.

BACKGROUND OF THE INVENTION

The present invention relates to a window module for partition panels and the like, and in particular to a knock-down window module that is quickly and easily assembled and installed on site.

Open office plans have been developed to reduce overall officing cost, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as work surfaces, overhead cabinets, shelves, etc., and are generally known in the office furniture industry as "systems furniture". Another arrangement for dividing and/or partitioning open plans includes modular furniture arrangements, in which a plurality of differently shaped, free standing furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent lease hold improvement.

One type of partition panel utilizes prefabricated panels having a generally rectangular perimeter frames that are interconnected along vertical side edges to form a partition wall. Such systems have redundant vertical structure along the side edges, resulting in increased costs. Furthermore, due to the size and weight of the prefabricated panels, wider and/or higher panels may be difficult to transport and handle at the installation site. Due to the excessive weight and size of a large prefabricated panel, the width and/or height of prefabricated panels is limited. Because smaller prefabricated panels must be used, additional vertical structure and connections are required along a given partition wall due to the greater number of prefabricated panels. Due to these limitations of prefabricated panels, knock-down panel frames that can be transported in individual pieces and assembled on site have been developed. This arrangement allows very wide and/or high panels to be used, thereby reducing the number of cover panels, frame members, and connectors required.

Prefabricated window panels that are compatible with prefabricated panel systems have been developed. However, prefabricated window panels have many of the same disadvantages as other types of prefabricated panels.

SUMMARY OF THE INVENTION

One aspect of the present invention is to provide a knock-down transparent module for partitions. The knock-down transparent module includes a pair of vertical side frame members, each having an upper end and a lower end. Upper and lower horizontal frame members have opposite ends and extend generally horizontally between the vertical side frame members adjacent the upper and lower ends thereof and interconnect the same adjacent the upper and lower ends to define a central opening through the module frame. A transparent sheet is secured to the module frame and extends across the central opening. The module frame defines outer faces having at least one hook shaped to engage an opening in a partition frame member, thereby permitting the module frame to be removably supported within a partition.

Another aspect of the present invention is a knock-down transparent module for partitions including a module frame with a pair of vertical side frame members, each having an upper end and a lower end and an outer face. Upper and lower horizontal frame members each having opposite ends extend generally horizontally between the vertical side frame members adjacent the upper and lower ends thereof and interconnect the same adjacent the upper and lower ends to define a rectangular opening through the module frame. The module frame also includes flanges adjacent the ends of one of the vertical and horizontal frame members, each flange having a clearance hole therethrough. Fasteners extend through the clearance holes in the flanges and rigidly interconnect the vertical and horizontal frame members. A transparent sheet is secured to the module frame, and extends across the rectangular opening. The outer faces of the vertical side frame members are adapted to interconnect with vertical posts of a partition to support the transparent module between a pair of the posts.

Yet another aspect of the present invention is a knock-down portable partition including a panel frame and a module unit. The panel frame has at least two vertical posts each having a side face with at least one module connection port thereon. The panel frame also includes upper and lower beams extending generally horizontally between the vertical posts and interconnecting the same. The knock-down portable partition also includes a module unit with a pair of vertical side frame members each having an upper end and a lower end, and an outer face. The module unit includes upper and lower horizontal frame members each having opposite ends and extending generally horizontally between the vertical side frame members adjacent the upper and lower ends thereof and interconnecting the same adjacent the upper and lower ends to define a quadrilateral opening through the module frame. The outer faces of the vertical side frame members of the module unit each have at least one connector engaging the module connection port of the posts to support the module unit between the posts.

Yet another aspect of the present invention is a knock-down transparent module for partitions including a module frame having a pair of vertical side frame members, each having an upper end and a lower end and an outer face. The module frame also includes upper and lower horizontal frame members, each having opposite ends and extending generally horizontally between the vertical side frame members adjacent the upper and lower ends thereof and interconnecting the same adjacent the upper and lower ends to define a rectangular opening through the module frame. The module frame defines an inner face. The transparent module includes a transparent assembly with a substantially transparent sheet having a rectangular perimeter defining upper and lower edges and opposite side edges. The transparent assembly also includes support members connected to each edge and extending therealong. Each support has an outer face with a contour corresponding to the inner face of the module frame. The transparent assembly is slidably received within the rectangular opening, and is connected to the module frame.

BRIEF DESCRIPTION OF THE DRAWINGS

FIG. 1;

FIG. 2;

DETAIL DESCRIPTION OF THE PREFERRED EMBODIMENTS

Figure 1:
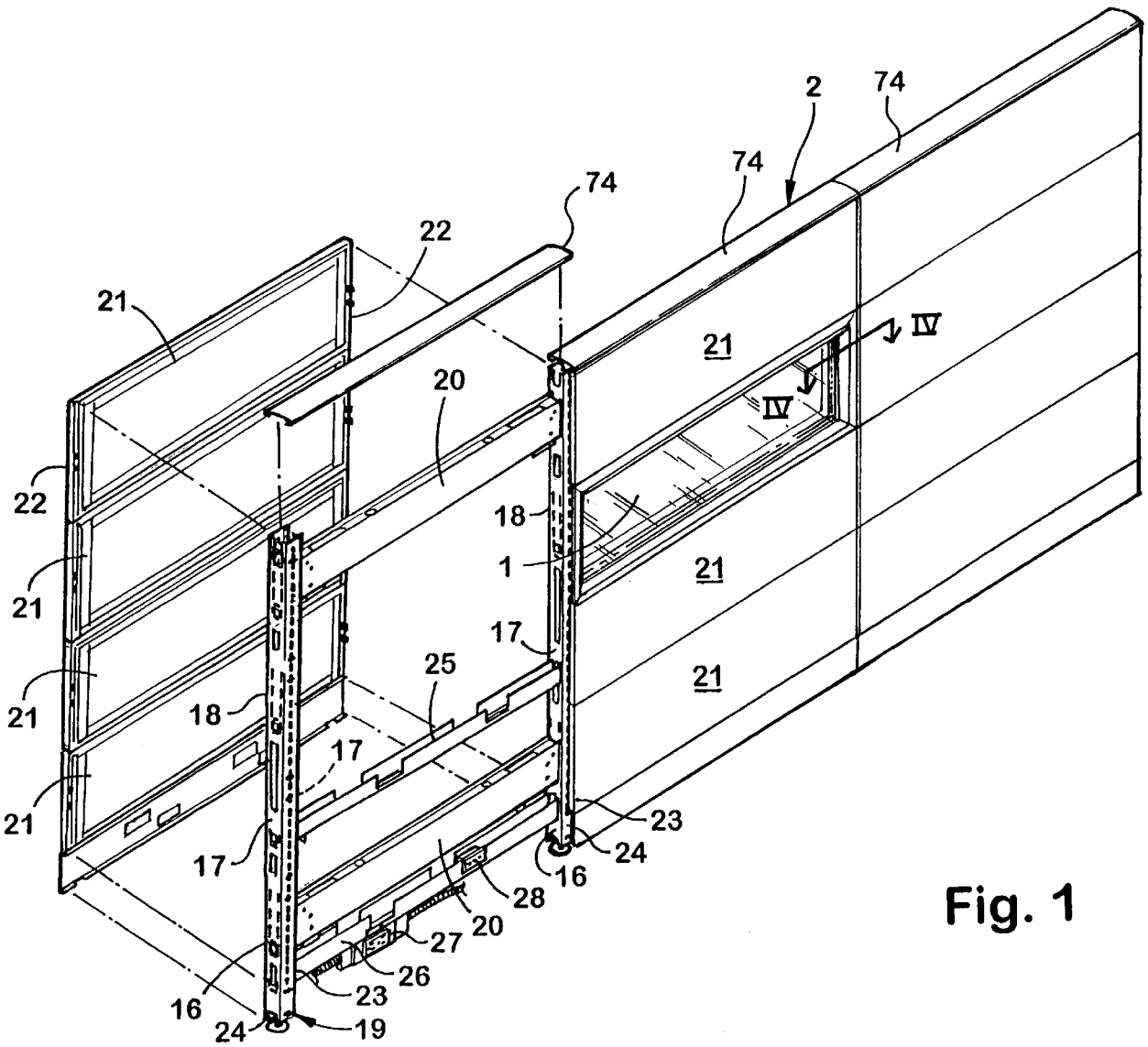
FIG. 1 is an exploded, perspective view of a partition panel system including a knock-down transparent module embodying the present invention.

For purposes of description herein, terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
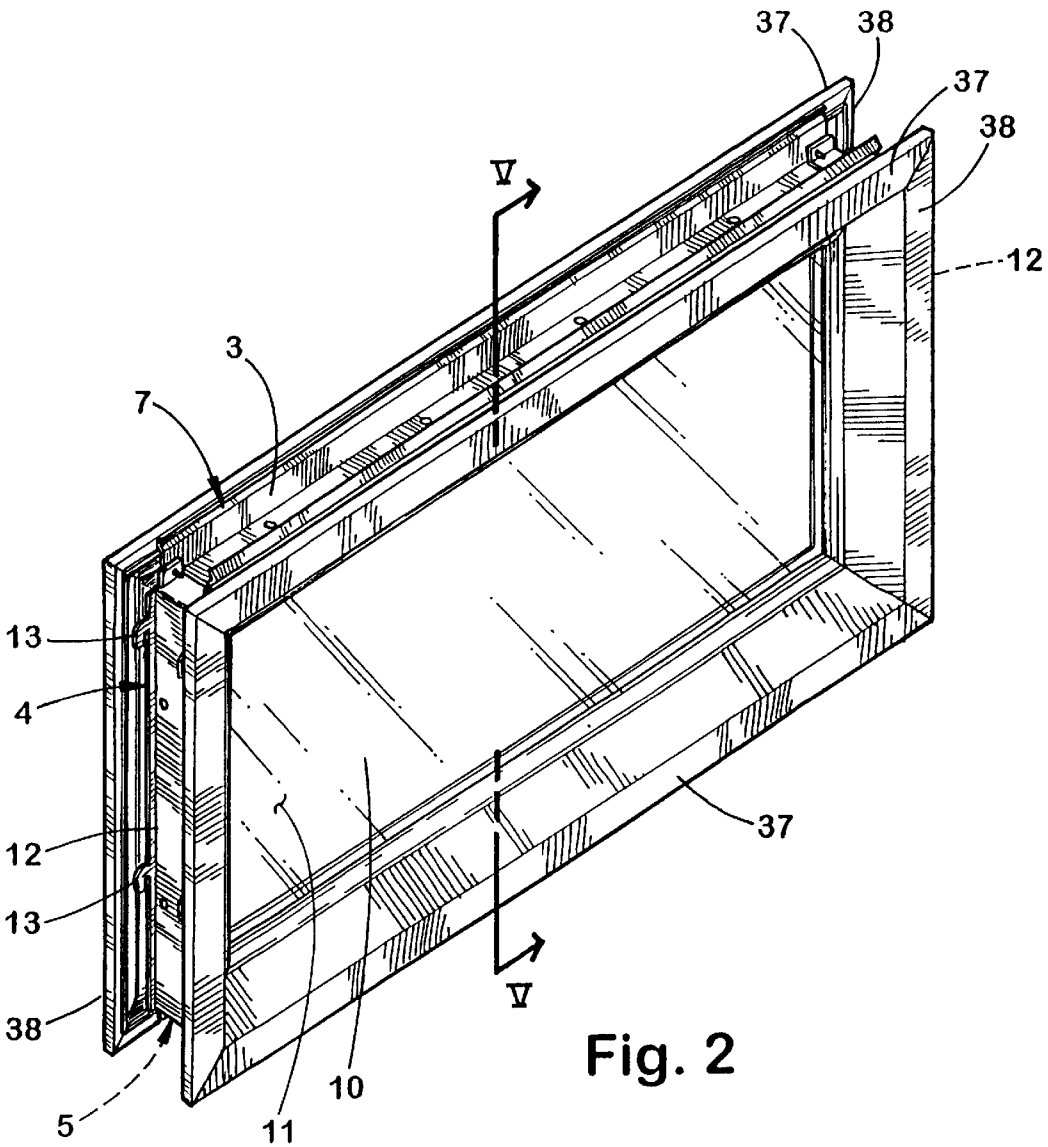
FIG. 2 is a perspective view of the glass module.

The reference numeral 1 (FIG. 1) generally designates a knock-down transparent module embodying the present invention, which is designed for use in partition panels 2 and the like. In the illustrated example transparent module 1 includes a module frame 3 (FIG. 2). The module frame 3 includes a pair of vertical side frame members such as brackets 4, each having an upper end 5 and a lower end 6. The module frame 3 also includes upper and lower horizontal frame members or channels 7, 8. Opposite ends 9 of horizontal frame members 7, 8 extend generally horizontally between the brackets 4 adjacent the upper and lower ends 5, 6 to define a central opening 10 through the module frame 3. A transparent sheet such as glass sheet 11 is secured to the module frame 3, and extends across the central opening 10. The module frame 3 defines at least two outer faces 12, each having at least one connector such as hook 13 shaped to engage an opening such as slots 15 in a partition frame member such as post 16, thereby removably supporting the module frame 3 within the partition 2.

Figure 3:
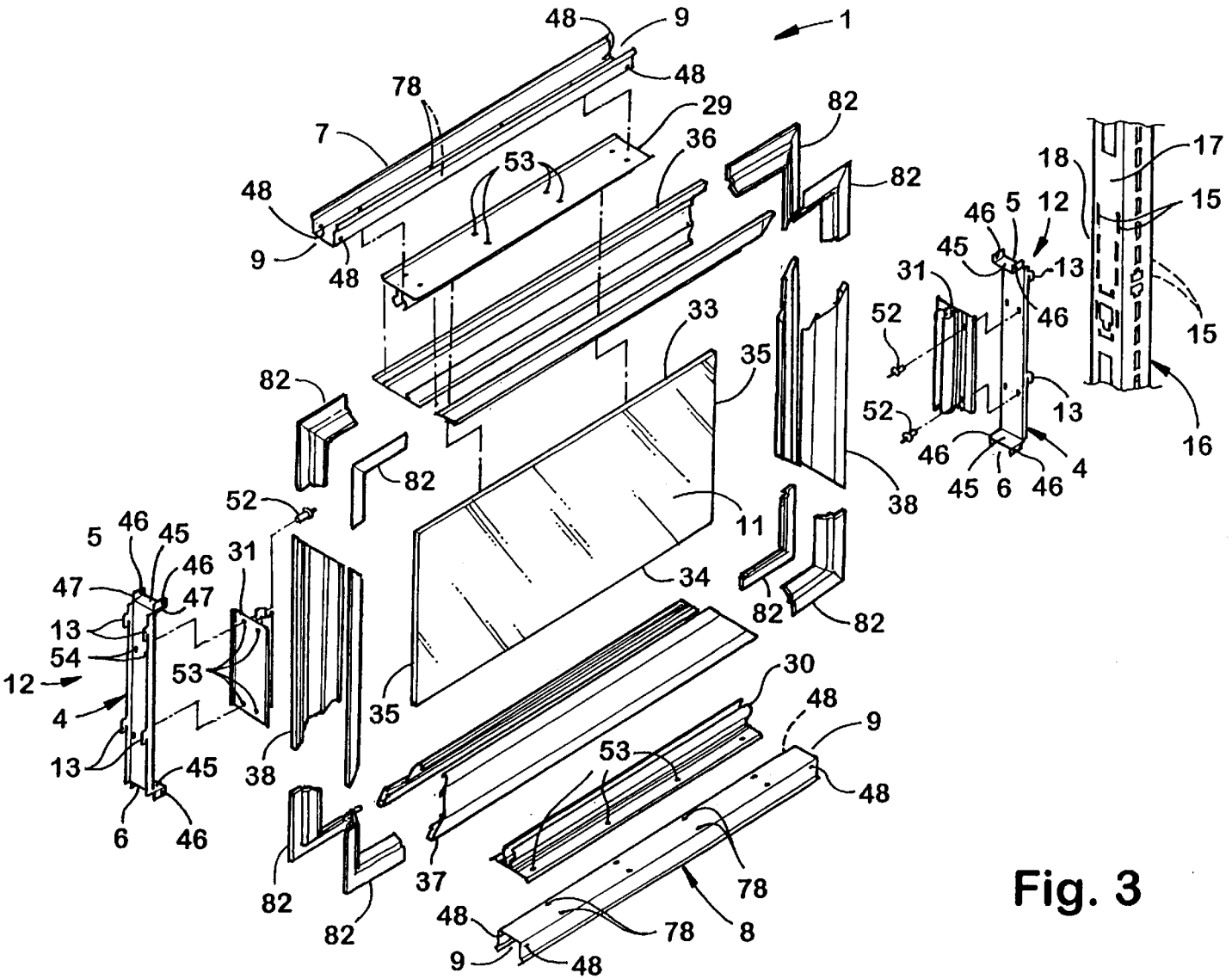
FIG. 3 is an exploded perspective view of the glass module.

As described in above-referenced co-pending U.S. patent application Ser. No. 08/856,995, entitled KNOCK-DOWN PORTABLE PARTITION SYSTEM, filed May 15, 1997, and in U.S. patent application Ser. No. 09/060,913, entitled KNOCK-DOWN PORTABLE PARTITION SYSTEM, filed on even date herewith, partition panel 2 (FIG. 1) includes at least two posts 16, each having a side face 17 with at least one module connection port 18 thereon. As best seen in FIG. 3, each module connection port 18 includes a plurality of slots or openings 15 that receive the hooks 13 of brackets 4 to removably support the transparent module 1 within the partition panel 2. The panel frame 19 (FIG. 1) also includes upper and lower beams 20 extending generally horizontally between the vertical posts 16 and interconnecting the same. One or more cover panels 21 are removably connected to the posts 16 along opposite side edges 22, and a vertical row of slots 23 in each front face 24 are provided for mounting hang-on accessories such as storage bins and worksurfaces (not shown). The partition panel 2 includes data troughs 25 and power troughs 26 for routing of data and power lines. The power troughs 26 can support power receptacles 27, as well as data receptacles 28. Slots 15 in the side face 17 of the post 16 form a beam connection port and a utility trough connection port and may be used to mount a beam 20 and/or data or power troughs 25, 26. Brackets 4 of the present invention are configured to utilize the slots 15 as a module connection port 18 for support of the transparent module 1 within the partition panel 2. Slots 15 have tapered sidewalls such that the upper edge of slot 15 is wider than the bottom edge. The top edge of slot 15 is 0.165 inches wide, and the bottom edge of slot 15 is 0.115 inches wide. Slot 15 is 1.100 inches high, and the side edges are parallel (i.e., 0.165 inches apart) along the top 0.800 inches, and taper inwardly starting at 0.300 from the bottom edge. The tapered sidewalls of slots 15 provide a secure, rigid interconnection between the hooks (not shown) at each end of beams 20 and slots 15. However, hooks 13 of brackets 4 are thinner than the lower edge width of slots 15 such that hooks 13 have a non-wedging, slightly loose interconnection with slots 15.

Transparent module 1 includes upper and lower horizontal support members 29 and 30 (FIG. 3), and vertical support members 31. Each support member is made of a polymer material such as polyvinyl chloride. As described in more detail below, upper and lower edges 33, 34 and opposite side edges 35 of the glass sheet 11 are secured to the horizontal frame members 7, 8 and brackets 4 to secure the glass sheet 11 within the module frame 3. As also described in more detail below, upper and lower horizontal trim members 36, 37 and vertical side trim members 38 are secured to the support members and cover the support members, frame members and brackets 4.

Figure 4:
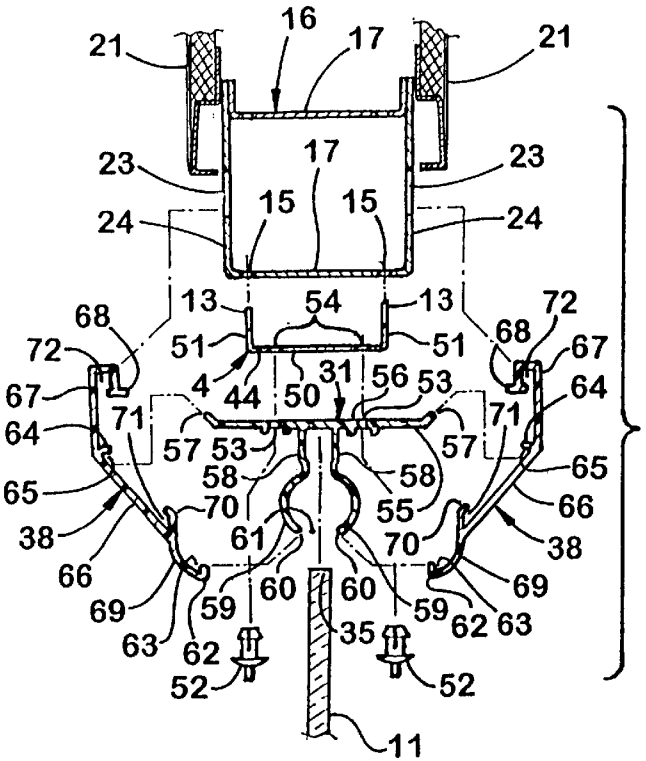
FIG. 4 is an exploded sectional view taken along the line IV—IV.
Figure 9:
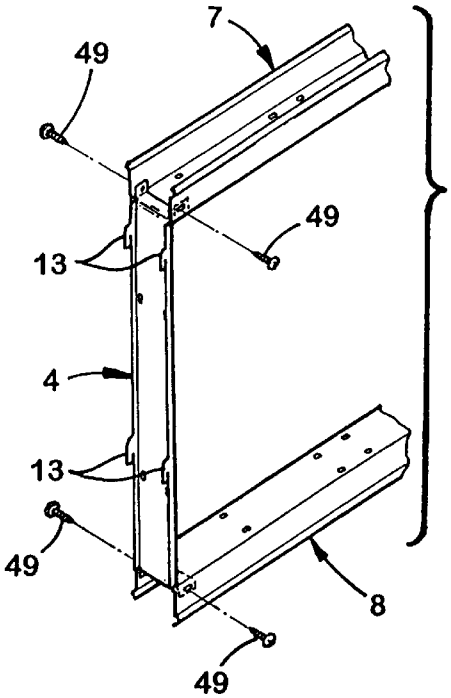
FIG. 9 is a fragmentary perspective view showing the interconnection of the horizontal frame members and a bracket.

Each bracket 4 includes a horizontally-extending flange 45 at upper and lower ends 5, 6. Each flange 45 includes a pair of upwardly-extending tabs 46. Each tab 46 includes a clearance hole 47 that is aligned with the corresponding clearance hole 48 in the corresponding upper or lower horizontal frame members 7, 8 to receive a fastener 49 during assembly of the module frame 3 (see also FIG. 9). With reference to FIG. 4, each bracket 4 has an outwardly-opening U-shaped cross section with a base wall 50, and a pair of outwardly-extending sidewalls 51 forming hooks 13. Base wall 50 of bracket 4 defines an inner face 44. When assembled, outer face 55 of vertical support member 31 abuts the inner face 44 of bracket 4. During assembly, removable plastic "thumb" rivets 52 are inserted through openings 53 in base wall 55 of vertical support member 31, and also through openings 54 in bracket 4 to interconnect the support member 31 with the bracket 4. Plastic rivets 52 may be Part No. SR-6080, Richco Plastic Company, 5825 North Tripp Avenue, Chicago, Ill. 60646. Vertical support member 31 includes a base wall 55 defining the outer face 56, and opposite side edges 57. A pair of parallel retaining walls 58 extend inwardly from the base wall 55, and include arcuate end sections 59 and inner edges 60. The retaining walls 58 define a gap 61 which receives an edge portion 35 of the glass sheet 11.

Figure 14:
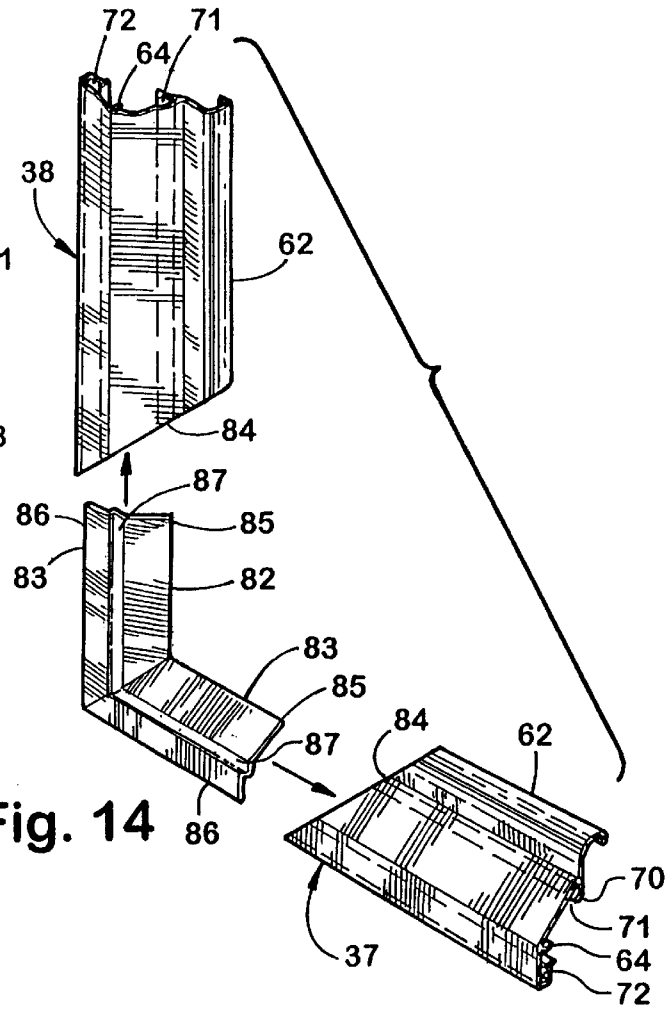
FIG. 14 is a fragmentary, perspective view showing the installation of the corner trim piece into the vertical and horizontal trim pieces.

Vertical side trim members 38 are made of a polymer material such as polyvinyl chloride with a durometer of 78, shore D scale. Inwardly-turned edge 62 forms a groove or recess 63 that receives the inner edge 60 of vertical support member 31 when assembled. Lip 64 forms a groove or recess 65 that receives a side edge 57 of vertical support member 31. A sidewall 38 extends at an angle between lip 64 and inwardly-turned edge 62, and forms with the base wall 55 and retaining wall 58 a generally triangular cross-sectional shape. Sidewall 67 extends outwardly from the lip and covers the bracket 4 and a portion of the post 16. When in an installed condition, edge portion 68 of sidewall 67 abuts the front face 24 of the post 16. End portion 69 of sidewall 66 has an arcuate contour that corresponds to end section 59 of retaining wall 58. As described in more detail below, extension 70 forms a V-groove 71 that cooperates with channel 72 to retain a corner trim member 82 (FIG. 14). As also described in more detail below, during installation of the trim member 38 on support member 31, groove 63 of inwardly-turned edge 62 is placed on inner edge 60 of retaining wall 58, and trim member 38 is rotated and flexed to engage groove 65 on side edge 57 of vertical support member 31. When in the installed position, inwardly-turned edge 62 of trim member 38 abuts glass sheet 11, and provides smooth, continuous external surfaces.

Figure 6:
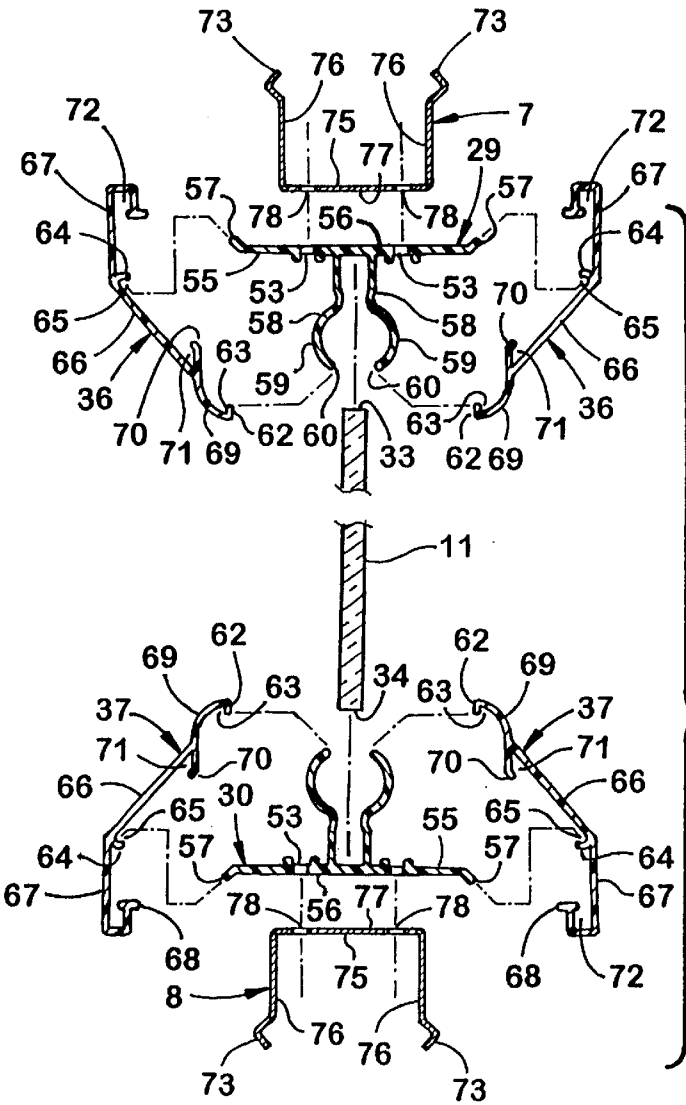
FIG. 6 is an exploded cross-sectional view of the glass module of FIG. 5.
Figure 5:
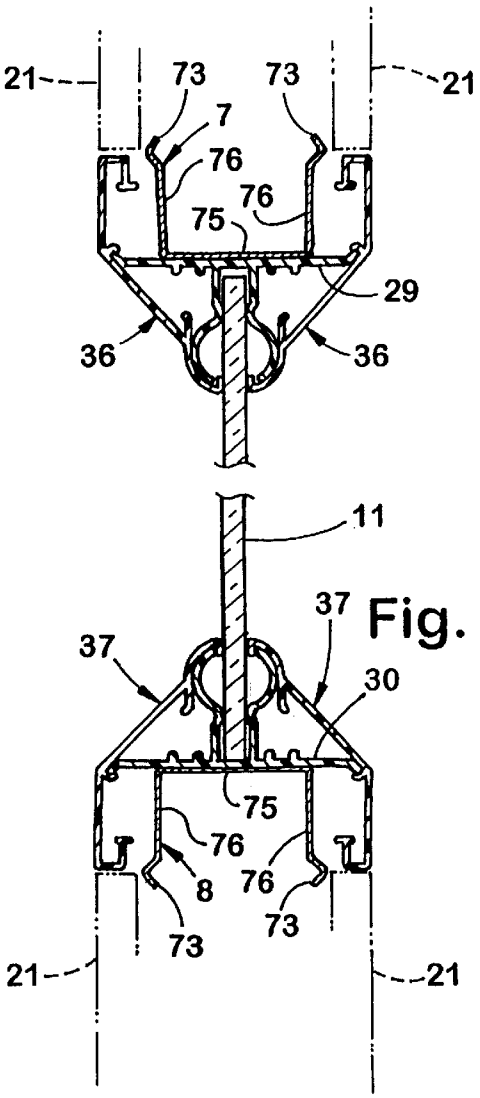
FIG. 5 is a fragmentary, cross-sectional view taken along the line V—V.

With reference to FIGS. 5 and 6, upper and lower horizontal frame members or channels 7 and 8 have a base wall 75 defining an inner face 77. Sidewalls 76 extend outwardly from base wall 75, forming an outwardly-opening U-shaped channel. End portions 73 of sidewalls 76 are configured to removably support a top cap 74 (see also FIG. 1) when module 1 is located at the top portion of partition panel 2. Thumb rivets 52 are inserted through clearance holes 53 in horizontal support members 29 and 30, and through clearance holes 78 in horizontal frame members 7 and 8 to secure the horizontal support members to the horizontal frame members in substantially the same manner as described above for the vertical support members 31 and brackets 4. Horizontal support members 29 and 30 have substantially the same cross-sectional shape as vertical support member 31. Horizontal trim members 36 and 37 also have substantially the same cross-sectional shape as vertical trim members 38 described above. Accordingly, the horizontal support and trim members will not be described in greater detail herein.

Figure 8:
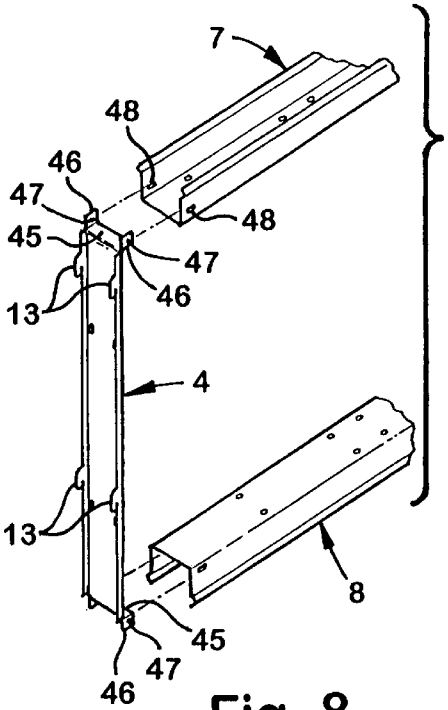
FIG. 8 is a fragmentary perspective view showing the interconnection of the horizontal frame members and a bracket.
Figure 7:
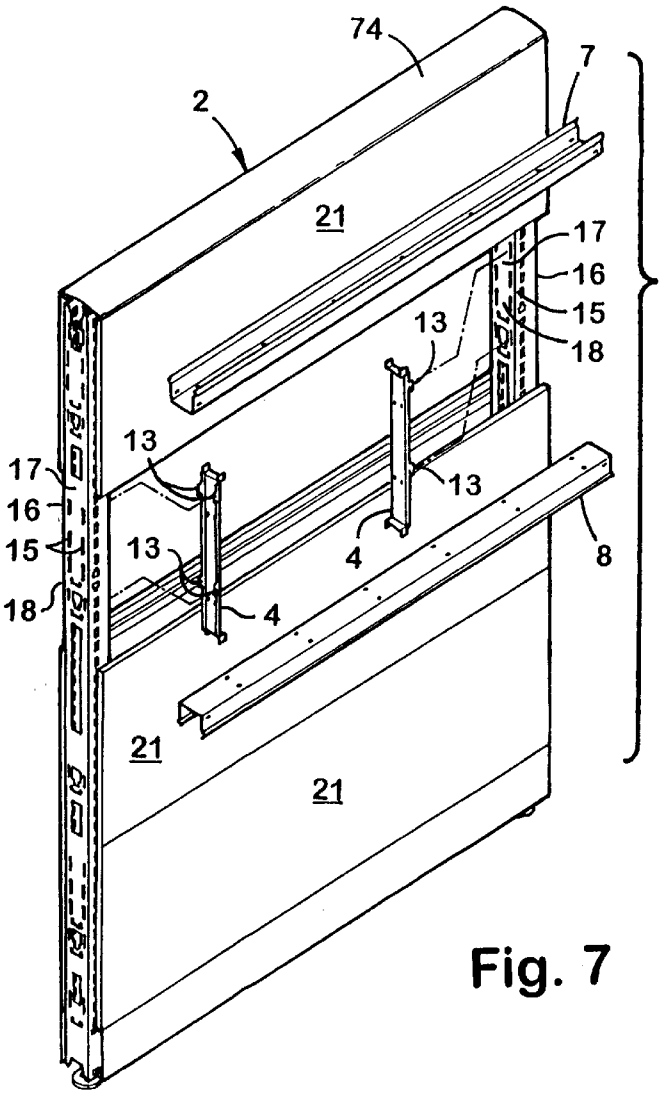
FIG. 7 is an exploded perspective view showing the installation of the horizontal frame members and brackets in a partition panel.
Figures 10, 11, 12:
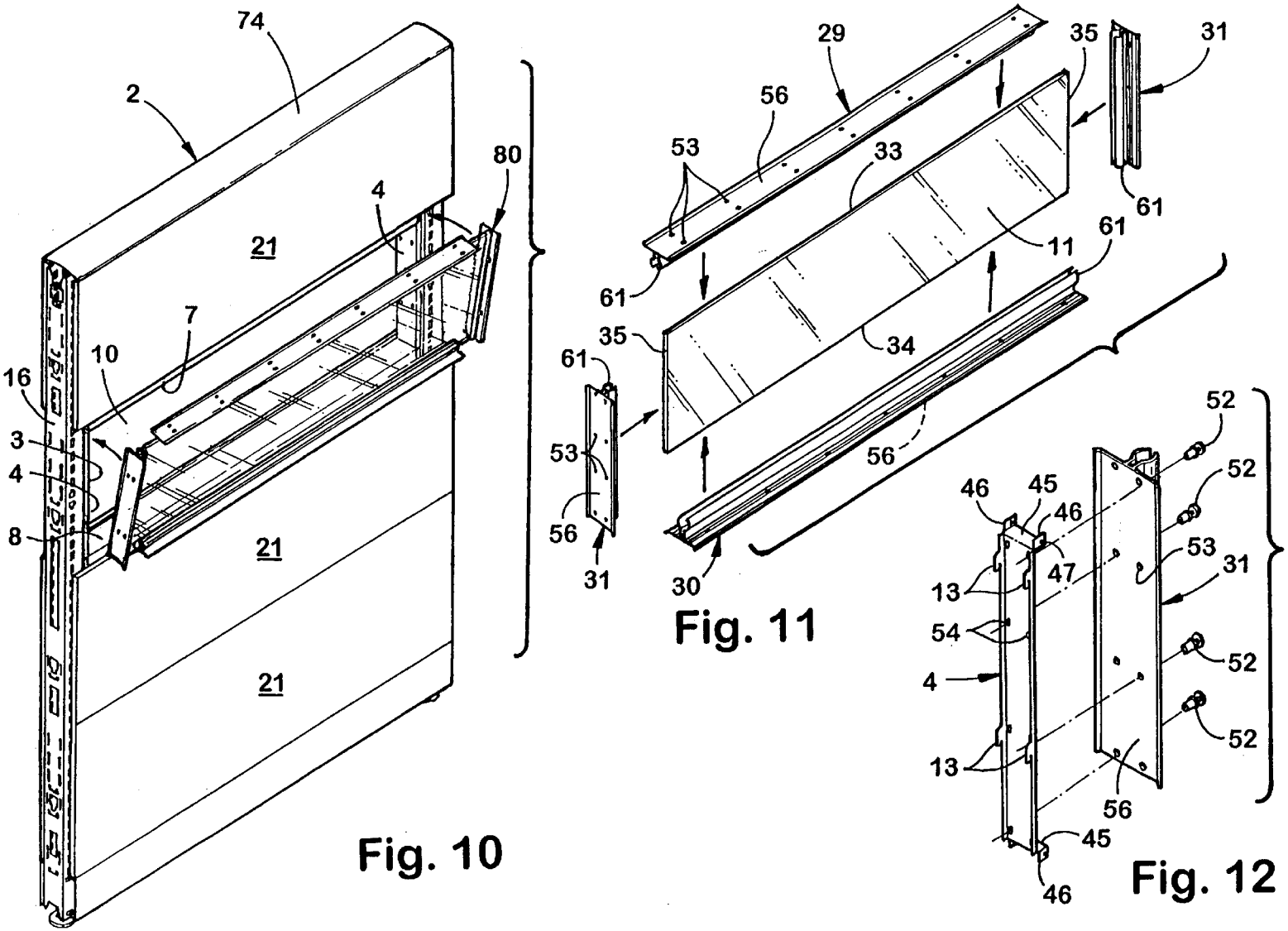
FIG. 10 is a fragmentary view of a panel showing the installation of the glass assembly.
FIG. 11 is an exploded view of the glass assembly showing the installation of the support members on the edges of the glass.
FIG. 12 is an exploded perspective view of a bracket and support member showing the installation of the thumb rivets.

With reference to FIG. 7, during assembly of the transparent module 1, brackets 4 are installed to the posts 16 by inserting the hooks 13 into the slots 15 of the module connection ports 18 on the side face 17 of each post 16. Horizontal frame members 7 and 8 are then interconnected to the brackets 4 by inserting fasteners 49 through clearance holes 47 and 48 of bracket 4 and horizontal frame members 7 and 8 (see also FIGS. 8 and 9). Vertical support members 31 are then installed on the side edges 35 of glass sheet 11, and upper and lower horizontal support members 30 and 31 are installed onto the upper and lower edges 33 and 34 of glass sheet 11 by inserting each side edge of glass sheet 11 into gap 61 of each support member (FIG. 11). As discussed above, brackets 4 and horizontal frame members 7 and 8 form a module frame 3 having a rectangular central opening 10. Glass sheet 11 and support members 29, 30 and 31 together form a transparent or glass assembly 80 that is slidably received within the rectangular central opening 10 during assembly (FIG. 10). As discussed above, when glass assembly 80 is installed within the module frame 3, the outer faces 56 of the support members abut the inner faces 44 and 77 of the brackets 4 and horizontal frame members 7 and 8.

Figure 13:
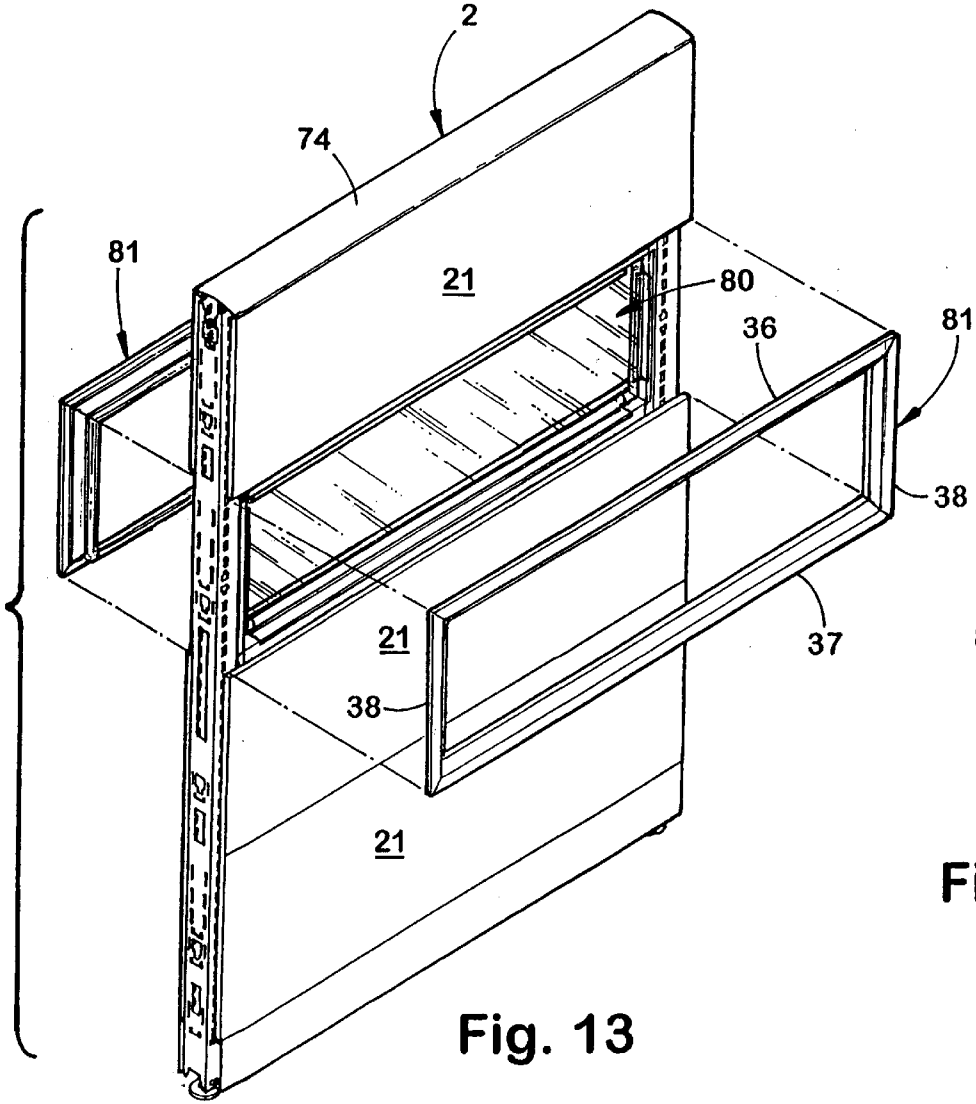
FIG. 13 is an exploded perspective view of a partition panel with a glass module showing the installation of the trim frame.

After the transparent assembly 80 is placed within the module frame 3, thumb rivets 52 are inserted through the clearance holes 53 and 54 in vertical support members 31 and brackets 4 to secure the vertical support member 31 to the bracket 4 (FIG. 12). Similarly, thumb rivets 52 are also inserted through openings 53 in horizontal support members 29 and 30, and through clearance holes 78 in horizontal frame members 7 and 8. With reference to FIGS. 13 and 14, trim frame 81 is assembled by inserting the end portions 83 of corner trim member 82 into the mitered, open end 84 of the horizontal and vertical trim members. Each end portion 83 of the corner trim member 82 has an outer edge 86 that is received within channel 72, and an inner edge 85 that is received within V-groove 71 formed by extension 70 (see also FIGS. 4, 6). A groove 87 in end portion 83 provides clearance for lip 64. Trim frame 81 is installed to the transparent assembly 80 by inserting the inwardly-turned edges 62 of the trim members 36–38 over the inner edges 60 of support members 29–31. Trim members 36–38 and 82 are made of a polymer material, such that trim frame 81 will flex sufficiently to permit insertion of the inwardly-turned edge 62 between glass sheet 11 and inner edge 60 of retaining walls 58. Trim members 36–38 are then rotated until the groove 65 formed by lip 64 snaps over the side edge 57 of the support members.

After the transparent module 1 is assembled, partition panel 2 can be disassembled, allowing transparent module 1 to be removed as a unit without disassembly. Partition panels 2 can be disassembled and reconfigured quickly without disassembly and reassembly of transparent module 1. The transparent module 1 is simply removed from the partition panel 2, and moved to the new location and installed as a unit. Alternatively, if required transparent module 1 can be readily disassembled and removed from panel frame 2 without disassembly of panel frame 2.

In the foregoing description, it will be readily appreciated by the skilled in the art that modifications may be made to the invention without departing from the concepts disclosed herein. Such modifications are to be considered as included in the following claims, unless these claims by their language expressly state otherwise.

What is claimed is:

1. A knock-down transparent module for partitions, comprising:

a module frame, including:

a pair of vertical side frame members each having an upper end and a lower end;

upper and lower horizontal frame members each having opposite ends and extending generally horizontally between said vertical side frame members adjacent said upper and lower ends thereof and securely interconnecting said vertical side frame members adjacent said upper and lower ends to define a rectangular module frame having a central opening therethrough;

a transparent sheet secured to said module frame and extending across said central opening; and said vertical side frame members of said module frame defining at least two outer faces, each having at least one hook shaped to engage an opening in a partition frame member permitting said module frame to be removably supported within a partition.

2. A knock-down transparent module as set forth in claim 1, wherein:

said central opening is rectangular;

said transparent sheet has a rectangular perimeter defining upper and lower edges and opposite side edges;

said horizontal and vertical frame members each define an inner face; and including:

support members defining outer faces, said support members connected to said upper and lower edges and said opposite side edges of said transparent sheet and extending along a portion thereof to define with said transparent sheet a transparent assembly, said transparent assembly slidably received within said rectangular opening with said outer faces of said support members abutting said inner faces of said frame members.

3. A knock-down transparent module as set forth in claim 2, wherein:

said support members have a base wall defining said outer face, and a pair of parallel retaining walls extending inwardly from said base wall and defining a gap therebetween with a portion of said transparent sheet disposed in said gap.

4. A knock-down transparent module as set forth in claim 3, including:

a trim frame connected to said transparent module and including vertically spaced-apart horizontal trim members and horizontally spaced-apart vertical trim members interconnected with said horizontal trim members to define a rectangular perimeter.

5. A knock-down transparent module for partitions, comprising:

a module frame, including:

a pair of vertical side frame members each having an upper end and a lower end and defining an inner face;

upper and lower horizontal frame members each having opposite ends and extending generally horizontally between said vertical side frame members adjacent said upper and lower ends thereof and interconnecting said vertical side frame members adjacent said upper and lower ends to define a rectangular central opening through said module frame;

a transparent sheet having a rectangular perimeter defining upper and lower edges and opposite side edges, said transparent sheet secured to said module frame and extending across said central opening;

said module frame defining at least two outer faces, each having at least one hook shaped to engage an opening in a partition frame member permitting said module frame to be removably supported within a partition;

support members defining outer faces, said support members connected to said upper and lower edges and said opposite side edges of said transparent sheet and extending along a portion thereof to define with said transparent sheet a transparent assembly, said transparent assembly slidably received within said rectangular opening with said outer faces of said support members abutting said inner faces of said frame members;

said support members having a base wall defining said outer face, and a pair of parallel retaining walls extending inwardly from said base wall and defining a gap therebetween with a portion of said transparent sheet disposed in said gap;

a trim frame connected to said transparent module and including vertically spaced-apart horizontal trim members and horizontally spaced-apart vertical trim members interconnected with said horizontal trim members to define a rectangular perimeter;

said base wall defines opposite side edges and said retaining walls each define an inner edge; and said trim members each have an inwardly-turned edge forming a groove receiving said inner edge of said retaining walls, said trim members further including a lip forming a groove receiving said side edges of said base walls.

6. A knock-down transparent module as set forth in claim 5, including:

corner trim members interconnecting said horizontal and vertical trim members.

7. A knock-down transparent module as set forth in claim 6, wherein:

said trim members have a sidewall extending between said inwardly-turned edge and said lip to form a generally triangular cross-section with said retaining wall and said base wall; said trim members including a sidewall extending from said lip over said frame members to cover the same.

8. A knock-down transparent module as set forth in claim 7, wherein:

said upper and lower ends of said vertical side frame members each include at least one horizontally-extending flange having an opening therethrough, and including:

fasteners extending through said openings and interconnecting said upper and lower ends of said vertical side frame members to said upper and lower horizontal frame members.

9. A knock-down transparent module as set forth in claim 8, wherein:

said upper and lower horizontal frame members comprise channels having a U-shaped cross section.

10. A knock-down transparent module for partitions, comprising:

a module frame, including:

a pair of vertical side frame members each having an upper end and a lower end and an outer face;

upper and lower horizontal frame members each having opposite ends and extending generally horizontally between said vertical side frame members adjacent said upper and lower ends thereof and interconnecting said vertical side frame members adjacent said upper and lower ends to define a rectangular opening through said module frame; flanges adjacent the ends of one of said vertical and horizontal frame members, each flange having a clearance hole therethrough;

fasteners extending through said clearance holes in said flanges and interconnecting said vertical and horizontal frame members;

a transparent sheet secured to said module frame and extending across said rectangular opening;

said outer faces of said vertical side frame members adapted to interconnect with vertical posts of a partition to support said transparent module between a pair of posts.

11. A knock-down transparent module as defined in claim 10, wherein:

said transparent sheet has a rectangular perimeter defining upper and lower edges and opposite side edges;

said horizontal and vertical frame members each define an inner face; and including:

support members defining outer faces, said support members connected to said upper and lower edges and said opposite side edges and extending along a portion thereof to define with said transparent sheet a transparent assembly, said transparent assembly slidably received within said rectangular opening with said outer faces of said support members abutting said inner faces of said frame members.

12. A knock-down transparent module as set forth in claim 11, wherein:

said support members have a base wall defining said outer face, and a pair of parallel retaining walls extending inwardly from said base wall and defining a gap therebetween with a portion of said transparent sheet disposed in said gap.

13. A knock-down transparent module as set forth in claim 12, including:

a trim frame connected to said transparent module and including vertically spaced-apart horizontal trim members and horizontally spaced-apart vertical trim members interconnected with said horizontal trim members to define a rectangular perimeter.

14. A knock-down transparent module as set forth in claim 13, wherein:

said base wall defines opposite side edges and said retaining walls each define an inner edge;

said trim members each have an inwardly-turned edge forming a groove receiving said inner edge of said retaining walls, said trim members further including a lip forming a groove receiving said side edges of said base walls.

15. A knock-down transparent module as set forth in claim 14, including:

corner trim members interconnecting said horizontal and vertical trim members.

16. A knock-down transparent module as set forth in claim 15, wherein:

said trim members have a sidewall extending between said inwardly-turned edge and said lip to form a generally triangular cross-section with said retaining wall and said base wall; said trim members including a sidewall extending from said lip over said frame members to cover the same.

17. A knock-down transparent module as set forth in claim 16, wherein:

said outer faces of said vertical said frame members include at least one hook shaped to engage an opening in a partition frame member.

18. A knock-down transparent module as set forth in claim 17, wherein:

said vertical side frame members have a base wall and a pair of sidewalls defining an outwardly-opening U-shaped cross section, each sidewall defining at least one hook shaped to engage an opening in a partition frame member.

19. A knock-down transparent module as set forth in claim 10, wherein:

said outer faces of said vertical said frame members include at least one hook shaped to engage an opening in a partition frame member.

20. A knock-down portable partition, comprising:

a panel frame, including:

at least two vertical posts each having a side face with at least one module connection port thereon;

upper and lower beams extending generally horizontally between said vertical posts and interconnecting said vertical posts;

a knock-down module unit, including:

a pair of vertical side frame members each having an upper end and a lower end and an outer face;

upper and lower horizontal frame members each having opposite ends and extending generally horizontally between said vertical side frame members adjacent said upper and lower ends thereof and interconnecting the same adjacent said upper and lower ends to define a rectangular module frame having a quadrilateral opening therethrough; and said outer faces of said vertical side frame members having at least one connector engaging said module connection port of said posts and supporting said module unit between said posts.

21. A knock-down portable partition as set forth in claim 20, wherein:

said module connection ports each include at least one opening;

said outer faces of said side frame members each include at least one hook engaging said opening to removably support said module unit within said panel frame; and said upper horizontal frame member having a rigid construction with an upwardly-opening U-shaped cross section.

22. A knock-down portable partition as set forth in claim 21, including:

a transparent sheet secured to said module frame and extending across said quadrilateral opening to define with said module frame a knock-down transparent module.

23. A knock-down portable partition as set forth in claim 22, wherein:

said transparent sheet has a rectangular perimeter defining upper and lower edges and opposite side edges;

said horizontal and vertical frame members each define an inner face; and including:

support members defining outer faces, said support members connected to said upper and lower edges and said opposite side edges and extending along a portion thereof to define with said transparent sheet a transparent assembly, said transparent assembly slidably received within said rectangular opening with said outer faces of said support members abutting said inner faces of said frame members.

24. A knock-down portable partition as set forth in claim 23, wherein:

said support members have a base wall defining said outer face, and a pair of parallel retaining walls extending inwardly from said base wall and defining a gap therebetween with a portion of said transparent sheet disposed in said gap.

25. A knock-down portable partition as set forth in claim 24, including:

a trim frame connected to said transparent module and including vertically spaced-apart horizontal trim members and horizontally spaced-apart vertical trim members interconnected with said horizontal trim members to define a rectangular perimeter.

26. A knock-down portable partition, comprising:

a panel frame, including:

at least two vertical posts each having a side face with at least one module connection port thereon;

upper and lower beams extending generally horizontally between said vertical posts and interconnecting said vertical posts;

a knockdown module unit, including:

a pair of vertical side frame members each having an upper end and a lower end and an outer face;

upper and lower horizontal frame members each having opposite ends and extending generally horizontally between said vertical side frame members adjacent said upper and lower ends thereof and interconnecting said vertical side frame members adjacent said upper and lower ends to define a module frame having a quadrilateral opening therethrough;

said outer faces of said vertical side frame members having at least one connector engaging said module connection port of said posts and supporting said module unit between said posts;

said module connection ports each include at least one opening;

said outer faces of said side frame members each include at least one hook engaging said opening to removably support said module unit within said panel frame;

a transparent sheet secured to said module frame having a rectangular perimeter defining upper and lower edges and opposite side edges and extending across said quadrilateral opening to define with said module frame a knock-down transparent module;

said horizontal and vertical frame members each defining an inner face;

support members defining outer faces, said support members connected to said upper and lower edges and said opposite side edges of said transparent sheet and extending along a portion thereof to define with said transparent sheet a transparent assembly, said transparent assembly slidably received within said rectangular opening with said outer faces of said support members abutting said inner faces of said frame members;

said support members having a base wall defining said outer face, and a pair of parallel retaining walls extending inwardly from said base wall and defining a gap therebetween with a portion of said transparent sheet disposed in said gap;

a trim frame connected to said transparent module and including vertically spaced-apart horizontal trim members and horizontally spaced-apart vertical trim members interconnected with said horizontal trim members to define a rectangular perimeter;

said base wall of said support members defining opposite side edges and said retaining walls each define an inner edge; and said trim members each having an inwardly-turned edge forming a groove receiving said inner edge of said retaining wall, said trim members further including a lip forming a groove receiving said side edge of said base wall.

27. A knock-down portable partition as set forth in claim 26, including:

corner trim members interconnecting said horizontal and vertical trim members.

28. A knock-down portable partition as set forth in claim 27, wherein:

said trim members have a sidewall extending between said inwardly-turned edge and said lip to form a generally triangular cross-section with said retaining wall and said base wall; said trim members including a sidewall extending from said lip over said frame members to cover the same.

29. A knock-down portable partition as set forth in claim 27, wherein:

said vertical side frame members have an outwardly-opening U-shaped cross section defining a base wall and a pair of sidewalls, each sidewall defining at least one hook shaped to engage an opening in a partition frame member.

30. A partition, comprising:

a partition frame having a pair of upright frame members, and a pair of horizontal frame members extending between and rigidly interconnecting said upright frame members to define a rectangular partition frame having a rectangular partition frame opening therethrough;

a module frame, including:

a pair of vertical side frame members each having an upper end and a lower end and an outer face;

upper and lower horizontal frame members each having opposite ends and extending generally horizontally between said vertical side frame members adjacent said upper and lower ends thereof and interconnecting said vertical side frame members adjacent said upper and lower ends to define a rectangular module frame having a rectangular opening through said module frame, said module frame defining an inner face;

said module frame closely received within said rectangular partition frame opening and secured to said partition frame;

a transparent assembly, including:

a substantially transparent sheet having a rectangular perimeter defining upper and lower edges and opposite side edges;

support members connected to each edge and extending therealong and having an outer face with a contour corresponding to said inner face of said module frame, said transparent assembly defining a rectangular perimeter smaller than said rectangular opening of said module frame to permit said transparent assembly to be slidably received within said rectangular opening of said module frame and connected to said module frame when said module frame is assembled and installed in said partition frame.

31. A partition as set forth in claim 30, wherein:

said support members have a base wall defining said outer face, and a pair of parallel retaining walls extending inwardly from said base wall and defining a gap therebetween with a portion of said transparent sheet disposed in said gap.

32. A partition as set forth in claim 31, wherein:

said vertical side frame members include connectors adapted to support said transparent module within a partition.

33. A partition as set forth in claim 32, wherein:

said outer faces of said side frame members each include at least one hook shaped to removably support said transparent module within a partition.

* * * * *

UNITED STATES PATENT AND TRADEMARK OFFICE

CERTIFICATE OF CORRECTION

PATENT NO. : 6,058,667
DATED : May 9, 2000
INVENTOR(S) : Douglas B. MacDonald et al.

It is certified that error appears in the above-identified patent and that said Letters Patent is hereby corrected as shown below:

Column 1, line 9;
"applicationis" should be --application is--.
Column 1, line 15;
"issues" should be --issued--.
Column 1, line 48;
Delete "a".
Column 3, line 52;
"DETAIL" should be --DETAILED--.
Column 6, line 65;
"the" should be --those--.
Column 9, line 65;
"said frame members" should be --side frame members--.
Column 10, line 10;
"said frame members" should be --side frame members--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*